United States Patent [19]

Leister

[11] Patent Number: 4,906,409

[45] Date of Patent: Mar. 6, 1990

[54] METHOD FOR THE TREATMENT AND CONVEYANCE OF FEED SLUDGE

[75] Inventor: Peter Leister, Waldbronn, Fed. Rep. of Germany

[73] Assignee: Deutsche Gesellschaft fur Wiederaufarbeitung von Kernbrennstoffen, Hanover, Fed. Rep. of Germany

[21] Appl. No.: 344,820

[22] Filed: Apr. 28, 1989

[30] Foreign Application Priority Data

May 4, 1988 [DE] Fed. Rep. of Germany ..... 3815082

[51] Int. Cl.[4] ..... G21F 9/16

[52] U.S. Cl. ..... 252/629; 252/628; 501/152; 501/155

[58] Field of Search ..... 252/629, 628; 432/13, 432/15; 501/152, 155

[56] References Cited

U.S. PATENT DOCUMENTS

| | | | |
|---|---|---|---|
| 3,943,062 | 3/1976 | Wielang et al. | 252/629 |
| 4,009,990 | 3/1977 | Bonniaud et al. | 432/13 |
| 4,202,792 | 5/1980 | Kaufmann et al. | 252/629 |
| 4,221,680 | 9/1980 | Hardwick et al. | 252/629 |
| 4,234,449 | 11/1980 | Wolson et al. | 252/629 |
| 4,314,909 | 2/1982 | Beall et al. | 252/629 |
| 4,352,332 | 10/1982 | Baston | 252/629 |
| 4,383,944 | 5/1983 | Ondracek | 252/629 |
| 4,490,287 | 12/1984 | Hardwick et al. | 252/629 |
| 4,499,833 | 2/1985 | Grantham | 252/632 |
| 4,668,435 | 5/1987 | Grantham | 252/632 |
| 4,759,879 | 7/1988 | Cadoff et al. | 252/629 |

*Primary Examiner*—Howard J. Locker

*Attorney, Agent, or Firm*—Allegretti & Witcoff, Ltd.

[57] ABSTRACT

Apparatus and method for treating and conveying feed sludge to a vitrification device in which sludge in suspension is dried in a fluid bed of preheated glass frit suspended in nitrogen gas. The mixture of dried glass frit and sludge is conveyed pneumatically in a stream of nitrogen gas to the vitrification device. The dried mixture flows through conduits without causing blockage which characterized the prior art.

4 Claims, 1 Drawing Sheet

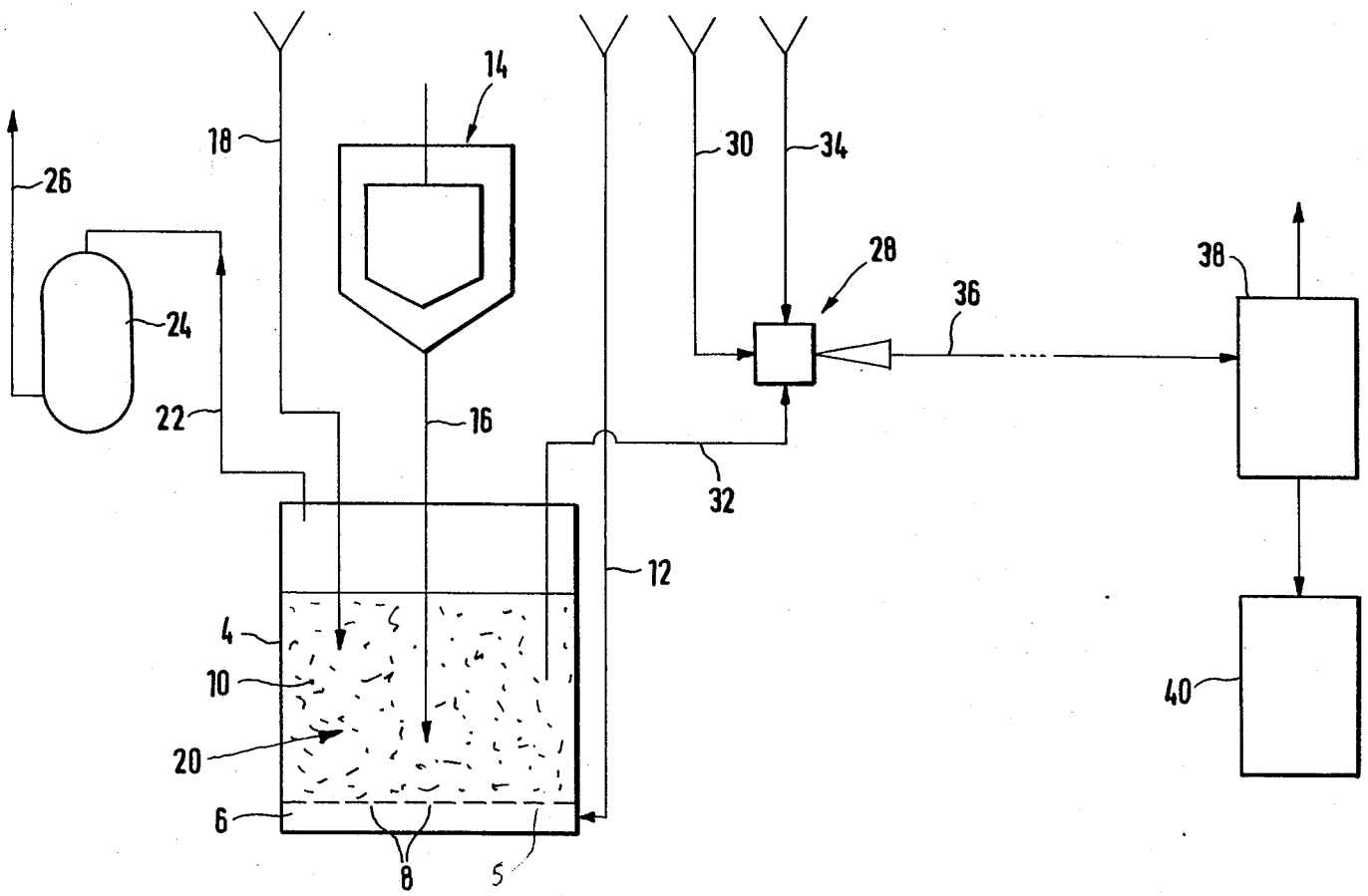
38
40
36
28
34
30
32
12
14
16
5
8
18
4
10
20
6
22
24
26

METHOD FOR THE TREATMENT AND CONVEYANCE OF FEED SLUDGE

BACKGROUND OF THE INVENTION

In reprocessing nuclear fuels the "feed clarification" step of the method produces a feed sludge in the form of a suspension which must be further treated and conveyed to final storage. For doing this, two different methods are used at present. The one method involves so-called "cementation", i.e., the bonding of the sludge suspension into cement mortar. The other method involves "vitrification". By both methods, solid bonds are generated, capable of final storage in which the feed sludge is fixed.

Feed clarification is usually effected by means of a centrifuge or by means of filters. The feed sludge suspension is discharged into a feed sludge container arranged directly below the centrifuge. From this container, the feed sludge suspension must be conveyed through pipes to the vitrification device. Independently of the further treatment of the feed sludge, glass frit is fed to the vitrification device. The conveyance of the feed sludge suspension is effected hydraulically by the sludge being sucked out of the feed sludge container by means of a steam-driven ejector nozzle and conveyed together with the condensate from the driving steam to the vitrification device. In this process, the sludge suspension leaving the centrifuge at high solids concentration becomes diluted by the condensate, which necessitates separating the suspension being conveyed from excess water of conveyance. Furthermore, the selection and design of the ejector conveyor section of the apparatus requires great care in order to guarantee blockage-free conveyance of the sludge to the next step of the process. In addition, the length of a hydraulically operated conveyor line is limited. This is disadvantageous because conveyance to the "vitrification" step of the method requires traversing a distance of over a hundred meters. By interposition of a further steam ejector, greater distances may indeed be traversed, but this increases the dilution of the sludge suspension which in turn increases the expense of separating the excess water from the sludge.

THE PRIOR ART

DE-OS No. 25 08 401 discloses a method and device for the vitrification of radioactive waste, i.e., for the inclusion of the radioactive waste in a glasslike mass. The radioactive waste and glass frit present in the form of aqueous solutions are introduced through separate inlet lines into an inclined rotary burning kiln and mixed together. Heating of the mixture is effected in the burning kiln arranged with a slope towards the outlet opening, and which contains a bed of sintered glass. The concentration of radioactive waste increases from the inlet opening to the outlet opening. The burnt and hot product of the mixture leaving the burning kiln flows into a melting furnace.

In the case of the so-called "pamela" method of vitrification of highly radioactive waste as described in CONF-790420, pages 86–92, a proportioning container is used in which glass frit is added to a radioactive aqueous solution of waste. The aqueous mixture is then fed via pipeline to vitrification equipment.

Both methods are subject to the risk of blockages in the conveyor lines for the aqueous mixtures.

THE INVENTION

The object of the present invention consists in an improvement in the vitrification method and apparatus mentioned initially which obviates the disadvantages of the prior art. More particularly, in accordance with the invention, the blockage of the pipes by the feed sludge is eliminated. Furthermore, the expense for removing the conveyor medium from the mixture being fed to vitrification is reduced.

According to the invention, feed sludge, with the addition of glass frit needed for the vitrification of the sludge, is mixed and dried. The dry solids mixture of dried feed sludge and glass frit may be conveyed without risk of line blockage over great distances at relatively low cost. The conveyance preferably is effected pneumatically. This has the further advantage that the separation of dried feed sludge and glass frit from the gaseous conveyor medium prior to vitrification may be performed efficiently and at very low cost.

The drying is effected by an inert drying-gas and/or by preheated glass frit, preferably in a fluidized bed of glass frit. It is advantageous to use glass frit for the fluidized bed drying since the glass frit is necessary anyway for vitrification. The glass frit moreover facilitates not only the drying, but also the conveyance of the feed sludge. The glass frit carries along with it dust constituents of the dried feed sludge during conveyance.

THE DRAWING

The invention is to be explained in greater detail below with the aid of the attached drawing which shows diagrammatically a device for the treatment of feed sludge and for the delivery of the treated feed sludge to a vitrification device.

DETAILED DESCRIPTION

The drawing shows a feed sludge container 4 which is in the form of a fluidized bed drier. For this purpose, the feed sludge container has a false bottom 5 forming a chamber 6 which is connected through perforations or nozzles 8 to the container space 10 above. A gas line 12 feeds a compressed inert drying gas, preferably nitrogen, into the chamber 6. A centrifuge 14 is disposed above the feed sludge container in which feed is clarified. A feed sludge suspension line 16 connects directly to the upper container space 10. Line 18 also connects to the upper container space 10 for feeding glass frit to container 4.

By blowing nitrogen gas through the nozzles or perforations in false bottom 5, a glass frit fluidized bed 20 is formed in the upper container space 10. The feed sludge suspension falls from the centrifuge into this glass frit fluidized bed 20 and in doing so, is continuously dried and mixed practically homogeneously with the glass frit. The drying of the feed sludge suspension is in this case effected by the drying gas and preferably with the assistance of heat from glass frit which has been heated prior to charging into container 4.

The gas flow charged with moisture is led away through vent line 22, dried in a moisture trap 24 (for example, a condenser) and fed to the exhaust gas line 26.

A conduit 32, 36 connects container 4 to a gas separator 38 and ultimately to vitrification device 40. An ejector 28 in line 32, 36 is powered by compressed gas (preferably nitrogen) fed through line 30. Glass frit mixed with dried feed sludge is drawn off continuously through line 32. Line 34 connecting to the ejector 28 serves to add glass frit in measured amounts to the glass frit/sludge mixture drawn off from the feed sludge container 4. The amount added produces a solids concentration suitable for the conditions of conveyance.

By means of the nitrogen gas conveying medium, the dried glass frit/feed sludge mixture flows through line 36 to a separator 38 which may, for example, be a cyclone precipitator to separate the gas from the glass frit/feed sludge mixture. The mixture is then fed to a vitrification device 40 which is remote from the feed sludge heater.

In the method described with the aid of the drawing, a fluidized bed 20 is formed from heated glass frit by blowing in the gas into the feed sludge container. The gas in the container is heated and charged with moisture from the feed sludge suspension thereby drying the sludge.

The mixture of dried feed sludge and glass frit consisting of a mixture of solids is drawn from the container 4 pneumatically by means of the ejector 28 and conveyed through the conduits pneumatically. In contrast to the state of the art in which relatively sticky aqueous stoppage-causing suspensions of solids are being conveyed, only dry solids are conveyed through the closed pipework. Dry solids conveyed pneumatically in this way greatly diminish the risk of blockage of the conduits.

It is further advantageous that glass frit which is necessary anyway for the vitrification process may be conveyed simultaneously with the dried feed sludge to the vitrification device. In that case, the flow consisting of glass frit (glass particles) and gas serves as the conveyor stream which draws off the dried feed sludge from the feed sludge container and conveys it to the vitrification device. The ratio between the amount of glass frit and the amount of feed sludge is set at the ratio necessary for vitrification. Any amount of added frit necessary to properly vitrify the dried sludge may be added through line 34 at the ejector. The separation of the mixture being fed to the vitrification device from the conveying gas is effected at much lower cost than the separation of the feed sludge suspension from the conveying water in accordance with the prior art.

What is claimed is:

1. A method for the treatment and delivery of a nuclear feed sludge suspension to be vitrified comprising admixing a predetermined quantity of preheated glass frit with said feed sludge suspension in a bed fluidized above flowing streams of inert drying gas, the quantity of glass frit being sufficient, with heat from said drying gas, to dry and subsequently vitrify said sludge,

- withdrawing said dried mixture from said fluidized bed,
- entraining said dried mixture in a flowing inert gas stream,
- conveying said dried mixture in said gas stream to a remote point,
- separating the gas from said dried mixture, and
- vitrifying said dried sludge.

2. The method of claim 1 in which additional glass frit, in an amount to produce a solids concentration suitable for conveyance, is added to said dried mixture in said flowing gas stream.

3. The method of claim 1 in which said inert gas is nitrogen.

4. The method of claim 1 in which said conveying step is performed in a conduit.

* * * * *